US005573061A

United States Patent [19]

Chiba et al.

[11] Patent Number: 5,573,061

[45] Date of Patent: Nov. 12, 1996

[54] HEAT EXCHANGER AND ARRANGEMENT OF TUBES THEREFOR

[75] Inventors: Tomohiro Chiba, Isesaki; Hisao Aoki, Maebashi, both of Japan

[73] Assignee: Sanden Corporation, Gunma, Japan

[21] Appl. No.: 460,156

[22] Filed: Jun. 2, 1995

Related U.S. Application Data

[63] Continuation of Ser. No. 297,154, Aug. 29, 1994.

[30] Foreign Application Priority Data

Aug. 30, 1993 [JP] Japan ..... 5-235880

[51] Int. Cl.[6] ..... F28F 9/22

[52] U.S. Cl. ..... 165/176; 165/174; 165/DIG. 481

[58] Field of Search ..... 165/173–176, 165/153

[56] References Cited

U.S. PATENT DOCUMENTS

| | | | |
|---|---|---|---|
| 1,769,743 | 7/1930 | Leblanc | 165/145 |
| 2,351,425 | 6/1944 | Hanson | 165/176 X |
| 2,733,899 | 2/1956 | Lehmann | 165/176 X |
| 3,835,920 | 9/1974 | Mondt . | |
| 4,825,941 | 5/1989 | Hoshino et al. . | |
| 4,936,381 | 6/1990 | Alley . | |
| 5,042,578 | 8/1991 | Tanabe . | |
| 5,097,900 | 3/1992 | Yamaguchi | 165/174 |
| 5,348,083 | 9/1994 | Hosoya et al. . | |

FOREIGN PATENT DOCUMENTS

| | | | |
|---|---|---|---|
| 148195 | 5/1992 | Japan | 165/174 |
| 2078361 | 1/1982 | United Kingdom . | |

*Primary Examiner*—Leonard R. Leo
*Attorney, Agent, or Firm*—Baker & Botts, L.L.P.

[57] ABSTRACT

A heat exchanger is provided with a first tank and a second tank. Heat transfer tubes are disposed between the tanks and are connected to the tanks to place the tanks in fluid communication. Either of the tanks may be divided into chambers by a partition. The partition has at least one portion which is oriented to be angularly offset from the direction of an air flow passing through the heat exchanger. The orientation of the partition permits the heat transfer tubes to be connected to the tanks in an arrangement so that no portion of the air flow can pass through the heat exchanger without striking at least one of the heat transfer tubes.

3 Claims, 6 Drawing Sheets

HEAT EXCHANGER AND ARRANGEMENT OF TUBES THEREFOR

This application is a continuation of application Ser. No. 08/297,154, filed Aug. 29, 1994.

BACKGROUND OF THE INVENTION

1. Field of the Invention

This invention relates to a heat exchanger and, more particularly, to an arrangement for heat transfer tubes in the heat exchanger.

2. Description of the Related Art

A typical arrangement for closely packed heat transfer tubes in a heat exchanger is shown, for example, in U.S. Pat. No. 4,235,281issued to Fitch et al.. Referring to FIGS. 1–3, a heat exchanger 10 comprises an upper tank 11, a lower tank 12, and a heat exchanger core 13 disposed between upper tank 11 and lower tank 12. Heat exchanger core 13 comprises a plurality of heat transfer tubes 15 spaced apart from each other and substantially parallel to one another. Upper tank 11 is divided into three chambers, such as first upper chamber 18, second upper chamber 19, and third upper chamber 20, by a first upper partition 11*a* and a second upper partition 11*b*. First upper partition 11*a* is perpendicular to a direction of air flow Q through heat exchanger core 13. Second upper partition 11*b* is parallel to air flow Q. First upper chamber 19 has the same capacity as third upper chamber 20.

Lower tank 12 is divided into two chambers, such first lower chamber 21 and second lower chamber 22 by lower partition 12*a*. First upper chamber 18 and third upper chamber 20 are respectively provided with inlet 16 and outlet 17 which connect heat exchanger 10 to an air conditioning system (not shown), i.e. a vehicle air conditioning system. Each of the plurality of heat transfer tubes 15 is joined at its opposite ends to upper tank 11 and lower tank 12.

A heat exchanger medium, a refrigerant for example, is introduced through inlet 16 into first upper chamber 18. The medium flows down through tubes 15 to first lower chamber 21 of lower tank 12. The medium then flows back up tubes 15 to second upper chamber 19. The medium then flows down tubes 15 to second lower chamber 22 and back up through tubes 15 to third upper chamber 20. The medium then exits the heat exchanger through outlet 17.

Generally, heat transfer tubes 15 are designed to be closely arranged so that the air flow Q, which passes across tubes 15, will strike each of the plurality of tubes 15. Generally, heat transfer tubes 15 cannot be connected to upper and lower tanks 11, 12 in the areas of partition portions 11*a*, 11*b*, and 12*a*. Therefore, tubes 15 are generally not disposed between tanks 11 and 12 in these areas. This absence of tubes creates a first pathway A along lower partition 12*a* and extending between upper and lower tanks 11, 12. A second pathway B is also created along partition 11*a* and extending between upper and lower tanks 11, 12. First pathway A is generally box-shaped and extends from a first end portion 13*a* of heat exchanger core 13 to a second end portion 13*b* of core 13. First pathway A is parallel to the direction of air flow Q. Second pathway B is also generally box-shaped and extends from a first side 13*c* of core 13 to a second side 13*d* of core 13. Second pathway B is generally perpendicular to air flow Q.

A volume of air flow, which passes through first pathway A, is generally greater than a volume of air flow which passes through the remaining space in heat exchanger core 13. Thus, a relatively large quantity of air can flow through heat exchanger 10 without exchanging heat with the medium flowing through the plurality of heat transfer tubes 15. As a result, the heat exchange efficiency of heat exchanger 10 is reduced.

Further, when a known heat exchanger is used as an evaporator, an evaporative capacity of the refrigerant cooling circuit is increased and, thus, a flow velocity of the circulating refrigerant is increased within the cooling circuit. As a result of the increased evaporative capacity and refrigerant flow velocity, refrigerant pressure tends to drop within the heat exchanger.

SUMMARY OF THE INVENTION

It is an object of the present invention to maximize the heat exchange efficiency of a heat exchanger by preventing air from flowing through a core of the heat exchanger without striking any of a plurality of heat transfer tubes of the core.

It is another object of the present invention to provide a heat exchanger wherein a pressure loss of refrigerant circuit using the heat exchanger can be minimized.

Accordingly, a heat exchanger which is exposed to an air flow is provided with a first tank and a second tank spaced apart from the first tank. A plurality of heat transfer tubes are disposed between the first and second tanks. Each of the tubes is connected at one end to the first tank and at the other end to the second tank. A partition is disposed within the first tank to divide the first tank into at least two chambers. The partition has at least one portion which is angularly offset from the direction of the air flow.

The partition may comprise a number of portions, at least one of which is angularly offset from the direction of the air flow. The portion may be substantially perpendicular to the direction of the air flow. Alternatively, the entire partition may be angularly offset from the direction of the air flow. According to one embodiment, the partition has three portions, two of which are parallel to the direction of the air flow and one of which is perpendicular to the direction of the air flow. In another embodiment, the partition comprises one substantially straight portion, the entirety of which is angularly offset from the direction of the air flow. In another embodiment, the partition is wave-shaped and has successively opposed cavities created by the shape of the partition.

A technical advantage of the present invention is that when heat transfer tubes are connected between the first and second tanks, no pathway exists which extends through the entire core entirely in the direction of the air flow. Thus, air is prevented from passing through the core without striking any of the heat transfer tubes.

Another technical advantage of the present invention is that when the heat exchanger is used as an evaporator, pressure losses of a refrigerant within the heat exchanger can be minimized by changing the shape of the partition to gradually increase the capacity of chamber within the tank. This causes refrigerant expansion, which reduces flow velocity, thereby maintaining relatively high refrigerant pressure.

Further objects, features, and other advantages of the present invention will be understood from the detailed description with reference to the appropriate figures.

DETAILED DESCRIPTION OF THE PREFERRED EMBODIMENTS

Figure 1:
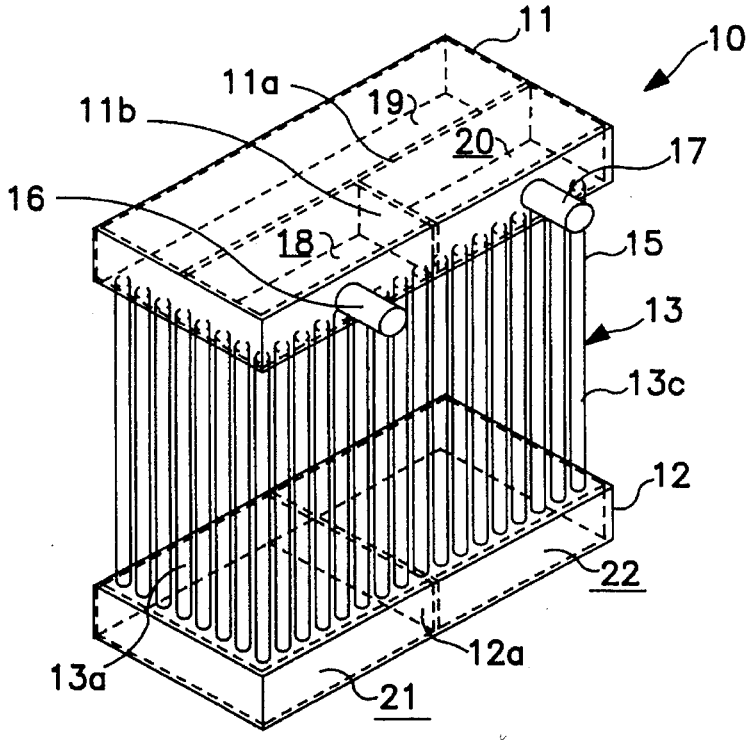
FIG. 1 PRIOR ART
FIG. 1 is a perspective view of a heat exchanger in accordance with the prior art.
Figure 2:
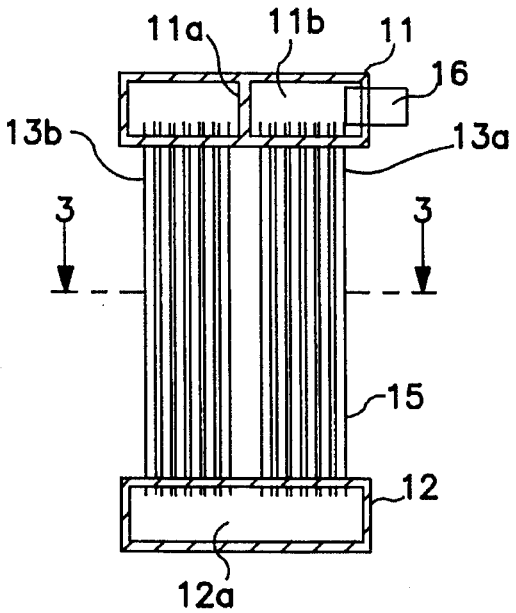
FIG. 2 PRIOR ART
FIG. 2 is a side view of the heat exchanger of FIG. 1.
Figure 3:
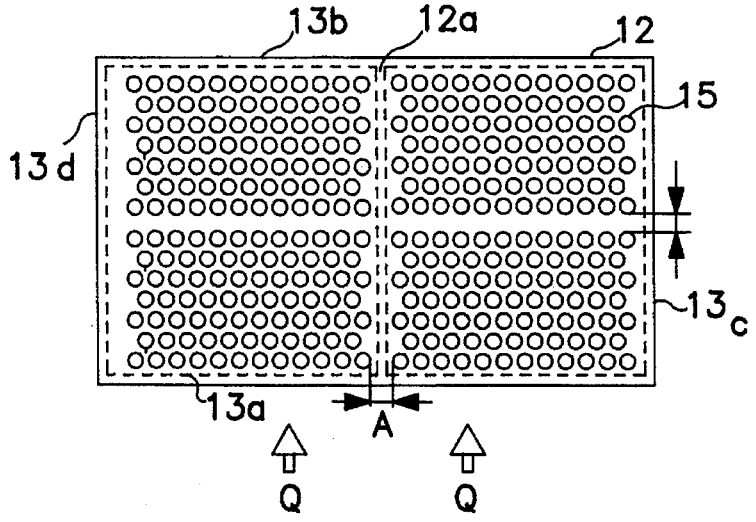
FIG. 3 PRIOR ART
FIG. 3 is a partial, cross-sectional view of the heat exchanger of FIG. 2 taken along line 3—3.

Several embodiments of the present invention are illustrated in FIGS. 4–10, in which the same numerals are used to denote elements which correspond to similar elements depicted in FIGS. 1–3. FIGS. 1–3 depict a heat exchanger according to the prior art. A detailed explanation of several elements and characteristics of the prior art heat exchanger of FIGS. 1–3 is provided above and is, therefore, omitted from this section. In several of the figures, an air flow Q is shown to represent a typical direction of an air flow which contacts the heat exchanger and thereafter flows through a core of the heat exchanger, thereby passing across the heat transfer tubes of the core.

Figure 4:
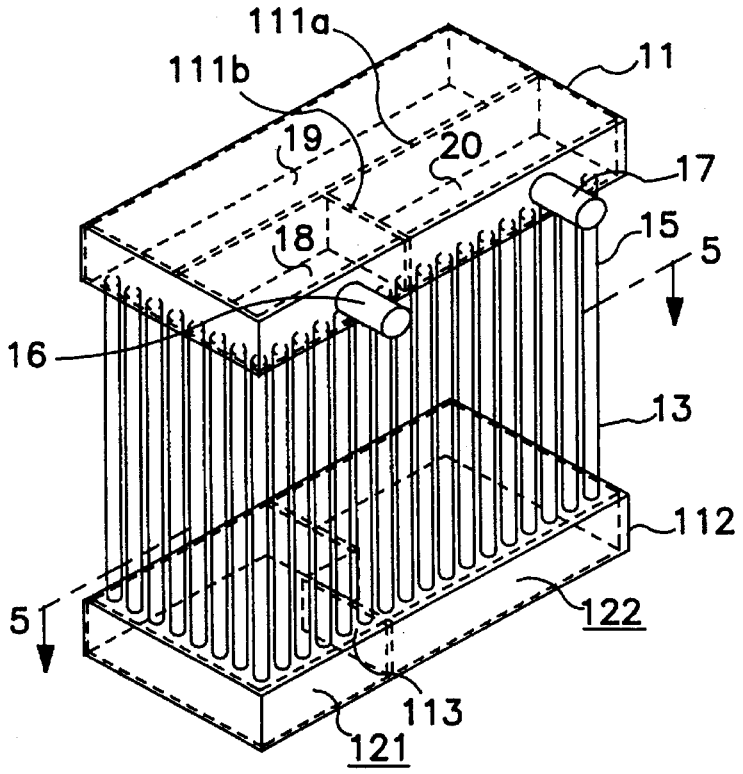
FIG. 4 is a perspective view of a heat exchanger according to a first embodiment of the present invention.
Figure 5:
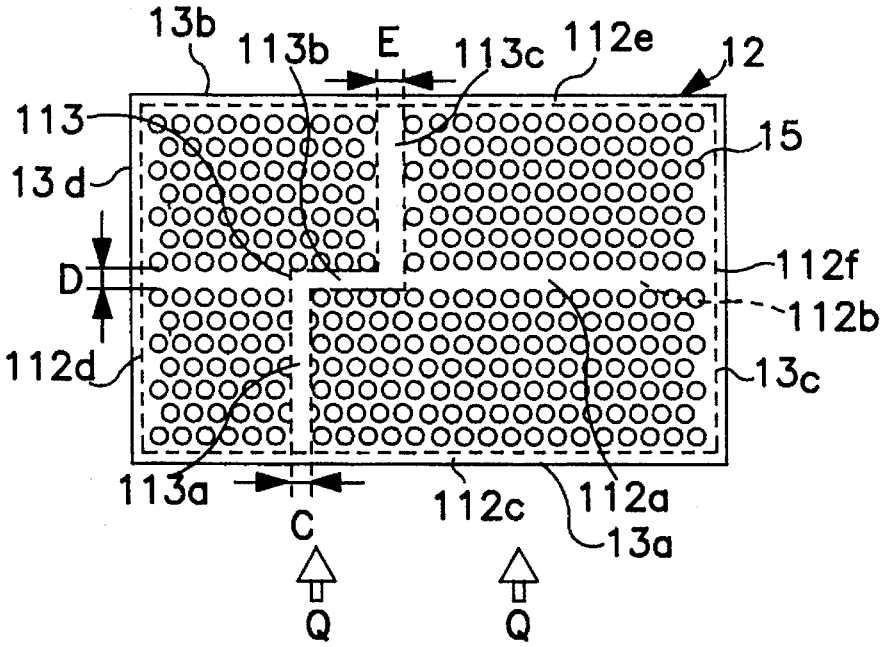
FIG. 5 is a partial, cross-sectional view of the heat of FIG. 4 taken along line 5—5.

FIGS. 4 and 5 illustrate a first embodiment of the present invention. A heat exchanger is provided with an upper tank 111 and a lower tank 112. Lower tank 112 comprises two plate portions, such as first lower plate portion 112a and second lower plate portion 112*b*. Lower tank 112 also comprises four side walls, such as first lower side wall 112*c*, second lower side wall 112*d*, third lower side wall 112*e*, and fourth lower side wall 112*f*. Preferably, plate portions 112*a*, 112*b* and side walls 112*c*, 112*d*, 112*e*, 112*f* form a substantially box-shaped tank. However, the tanks of heat exchanger 110 can be of a variety of shapes and still benefit from the present invention.

Lower tank 112 includes a lower partition 113, which is preferably formed therein to be substantially perpendicular to both first lower plate portion 112*a* and second lower plate portion 112*b*. Lower partition 113 divides lower tank 112 into two chambers, such as first lower chamber 121 and second lower chamber 122. Further, lower partition 113 comprises a first portion 113*a*, which preferably extends from first lower side wall 112*c*. A second portion 113*b* preferably extends from an end of first portion 113*a* to a central region of lower tank 112. A third portion 113*c* of lower partition 113 extends from second portion 113*b* to third lower side wall 112*e*.

First portion 113*a* and third portion 113*c* are preferably formed so that they are oriented substantially perpendicular to both first lower side wall 112*c* and third lower side wall 112*e*. Thus, first and third portions 113*a* and 113*c* generally lie in the direction of air flow Q. Second portion 113*b* is preferably formed so that it is oriented substantially parallel to first lower side wall 112*c* and third lower side wall 112*e*. Thus, second portion 113*b* is angularly offset from the direction of air flow Q and is preferably substantially perpendicular to the direction of air flow Q.

The configuration of lower partition 113 results in a first pathway C, a second pathway D, and a third pathway E through heat exchanger core 13 when heat transfer tubes 15 are disposed between and connected to first and second tanks 112, 113. Pathways C,D, and E correspond to portions 113*a*, 113*b*, and 113*c*, respectively. Second pathway D is preferably substantially perpendicular to the direction of air flow Q. The result of this configuration is the avoidance of a single pathway extending from first end portion 13*a* of core 13 to second end portion 13*b* of core 13, the entirety of which is parallel to the direction of air flow Q. Thus, no portion of air flow Q can pass through heat exchanger core 13 without striking any of the plurality of heat transfer tubes 15. This feature of the present invention is an advantage over the prior art which allows a portion of the air flow to pass through the heat exchanger core without striking any heat transfer tubes. The configuration shown in FIGS. 4 and 5, therefore, improves the heat exchanging efficiency of heat exchanger 10 as compared with the prior art heat exchanger shown in FIGS. 1–3.

Figure 6:
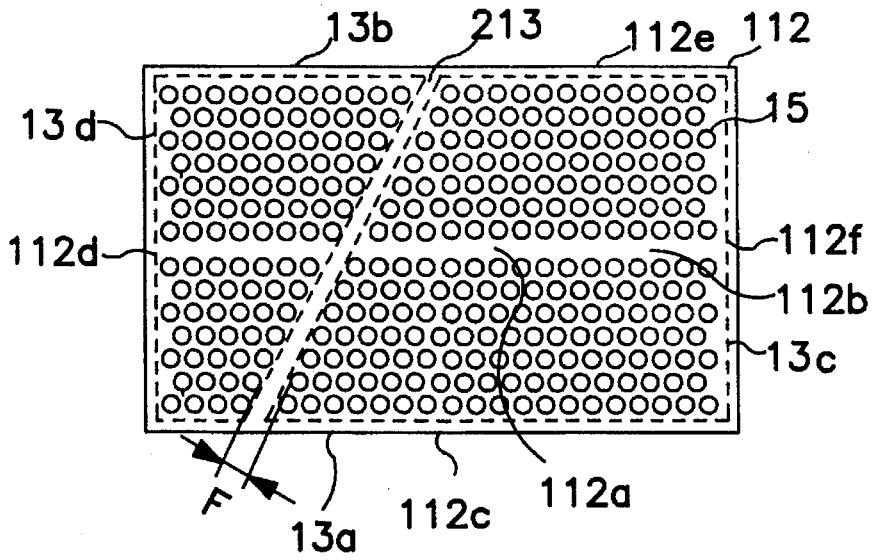
FIG. 6 is a partial, cross-sectional view of a heat exchanger according to a second embodiment of the present invention.
Figure 11:
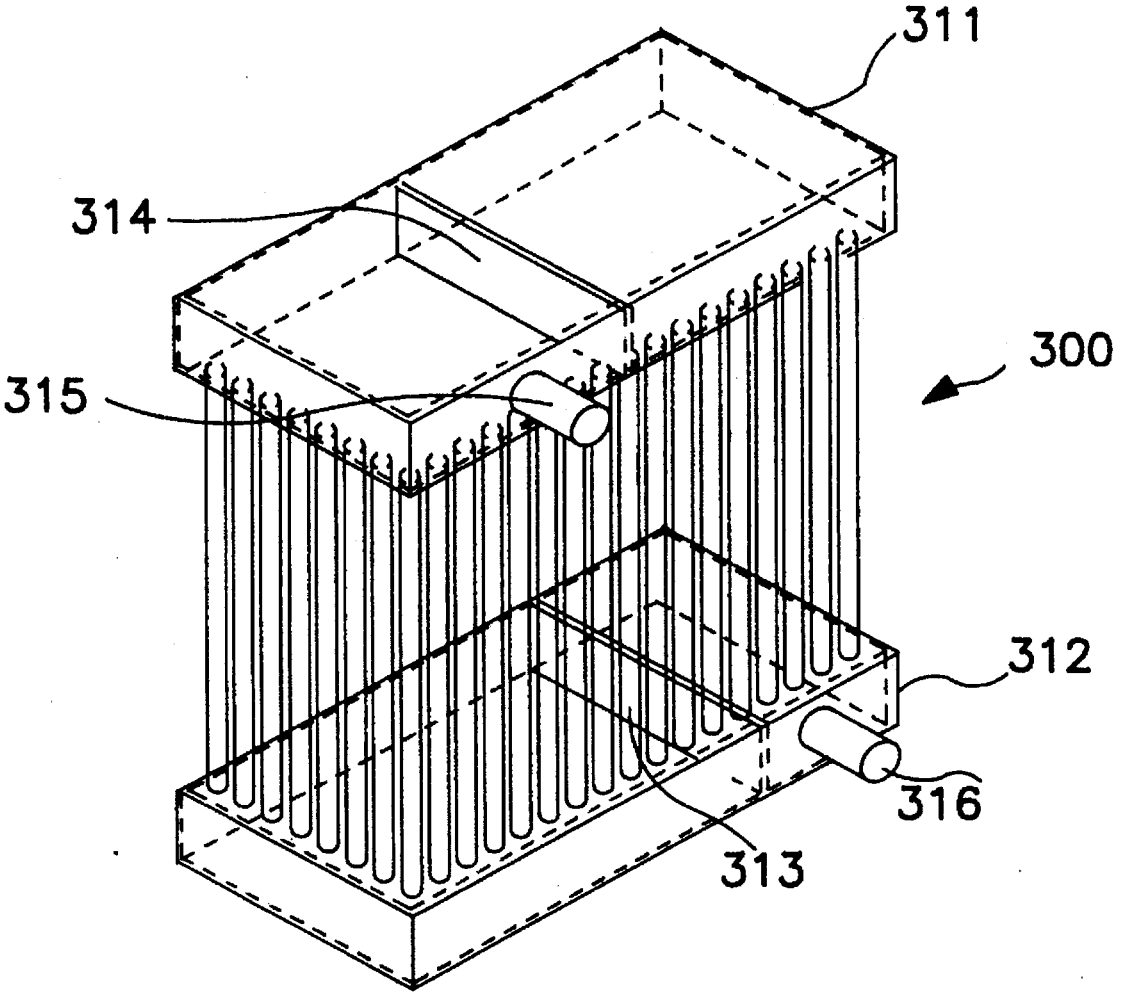
FIG. 11 is a perspective drawing of a heat exchanger in accordance with an embodiment of the present invention.

Further, when a known heat exchanger is used as an evaporator, an evaporative capacity of the refrigerant cooling circuit is increased and, thus, a flow velocity of the circulating refrigerant is increased within the cooling circuit. As a result of the increased evaporative capacity and refrigerant flow velocity, refrigerant pressure tends to drop within the heat exchanger. Nevertheless, in this embodiment, the capacity of 10 chamber 122 can be gradually increased by changing the shape of partition 113 in tank 112. Therefore, as the refrigerant circulates through the heat exchanger, refrigerant expansion within chamber 122 causes lower refrigerant flow velocity and maintains higher refrigerant pressure.As shown in FIG. 4, upper tank 111 has one more partition than lower tank 112. Thus, inlet 16 and outlet 17 are both located in upper tank 111. However, if the lower tank is partitioned to have the same number of chambers as the upper tank, the outlet can be located in the lower tank. In other words, the inlet and outlet would be located in opposed tanks. As shown in FIG. 11, for example, a heat exchanger 300 has uper tank 311 having a single partition 314 and a lower tank 312 also having a single partition 313. Thus, upper FIG. 6 illustrates a second embodiment of the present invention. Lower tank 112 has lower partition 213, which is preferably formed therein to be substantially perpendicular to both first lower plate portion 112*a* and second lower plate portion 112*b*. Lower partition 213 divides lower tank 112 into two chambers similar to the previous embodiment. Lower partition 213 preferably extends from first lower side wall 112*c* to third lower side wall 112*e* so that partition 213 is angularly offset from and integrally oblique to the direction of air flow Q. The configuration of lower partition 213 results in a pathway F in heat exchanger core 13 when heat transfer tubes 15 are disposed between and connected to first and second tanks 112, 113. Pathway F corresponds to partition 213. Pathway F is thus angularly offset from and integrally oblique to the direction of air flow Q. The result of this configuration is the avoidance of a single pathway extending from first end portion 13*a* of core 13 to second end portion 13*b* of core 13, the entirety of which is parallel to the direction of air flow Q. Thus, no portion of air flow Q can pass through heat exchanger core 13 without striking any of the plurality of heat transfer tubes 15. Other advantages and features of the embodiment depicted in FIG. 6 are similar to those described above in connection with the first embodiment.

Figure 7:
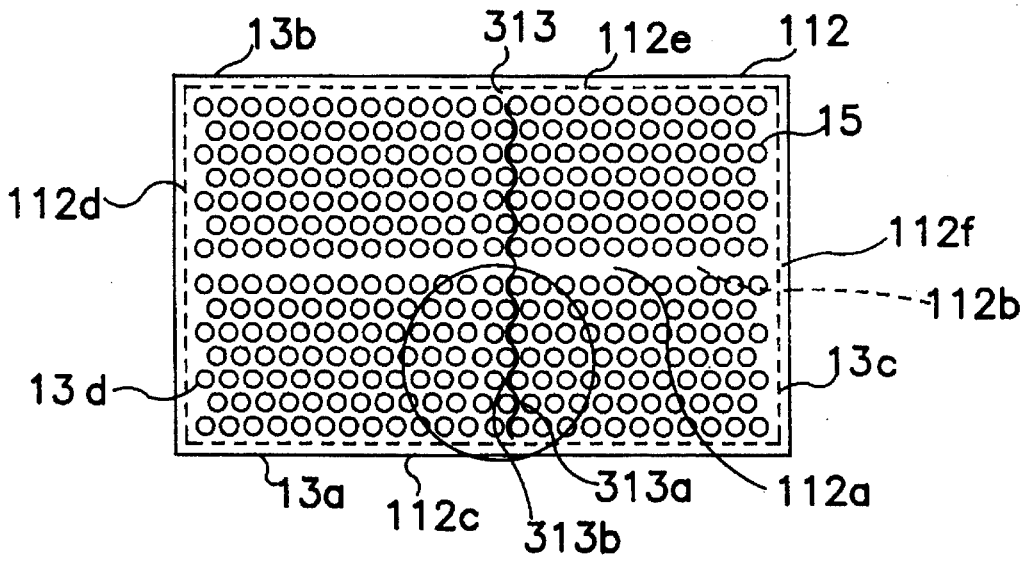
FIG. 7 is a partial, cross-sectional view of a heat exchanger according to a third embodiment of the present invention.
Figure 8:
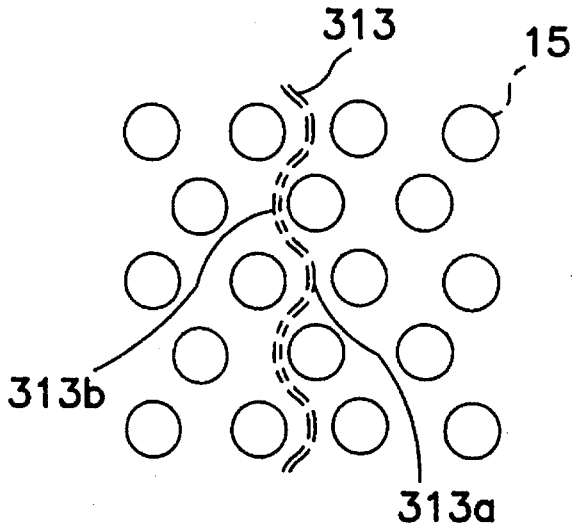
FIG. 8 is an enlarged, partial, cross-sectional view of the heat exchanger of FIG. 7.

FIGS. 7 and 8 illustrate a third embodiment of the present invention. Lower tank 112 includes lower partition 313, which is preferably formed therein to be substantially perpendicular to both first lower plate portion 112a and second lower plate portion 112*b*. Lower partition 313 divides lower tank 112 into two in a manner similar to the previous embodiments. Partition 313 preferably extends from first lower side wall 112*c* to third lower side wall 112*e* and is generally wave-shaped. Partition 313 has successively opposed cavities (e.g., at 313*a* and 313*b*). One of the plurality of heat transfer robes 15 is preferably connected to lower tank 112 at each of the successively opposed cavities of partition 313 so that the opening of a tube 15 opens into each of the cavities. Thus, if lower partition 313 was projected into heat exchanger core 13, partition 313 would be oriented so as to weave back and forth between successive heat transfer tubes 15.

Partition 313 generally follows the direction of air flow Q. However, because partition 313 is wave-shaped, its successively opposed cavities each define a portion of partition 313 which is angularly offset from the direction of air flow Q. Preferably, lower partition 313 has a thickness which is smaller than a pitch of the tube arrangement of core 13. The configuration of partition 313 preferably results in no pathway through core 13. Thus, no portion of air flow Q can pass through core 13 without striking any of tubes 15. Other features and advantages of this embodiment are similar to those described above. Also, it will be easily understood by those having ordinary skill in the pertinent art that the features and advantages achieved by the various partitions of the above-described embodiments can be achieved by the use of similar partitions in upper tank 111.

Figure 9:
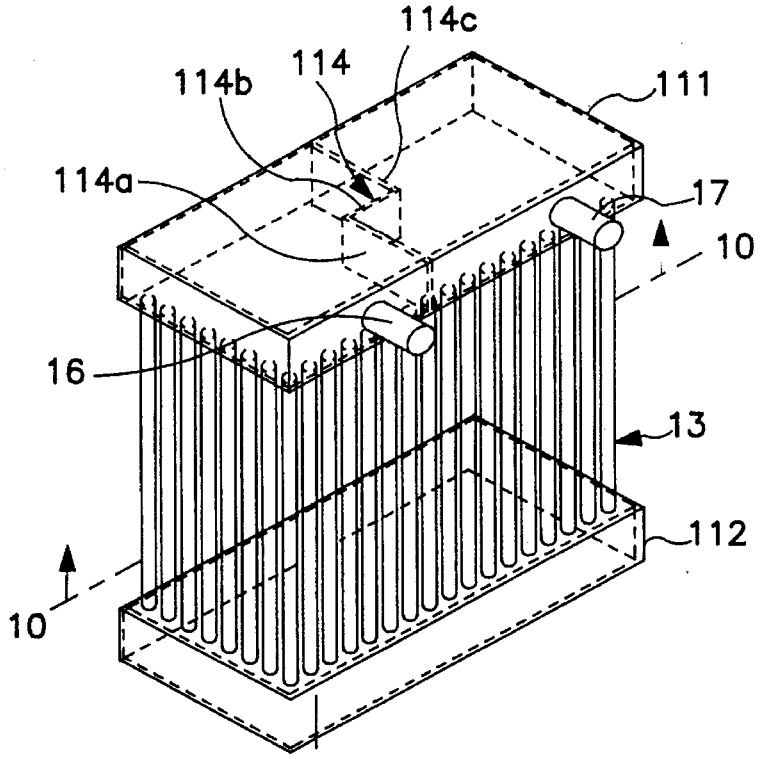
FIG. 9 is a perspective view of a heat exchanger according to a fourth embodiment of the present invention.
Figure 10:
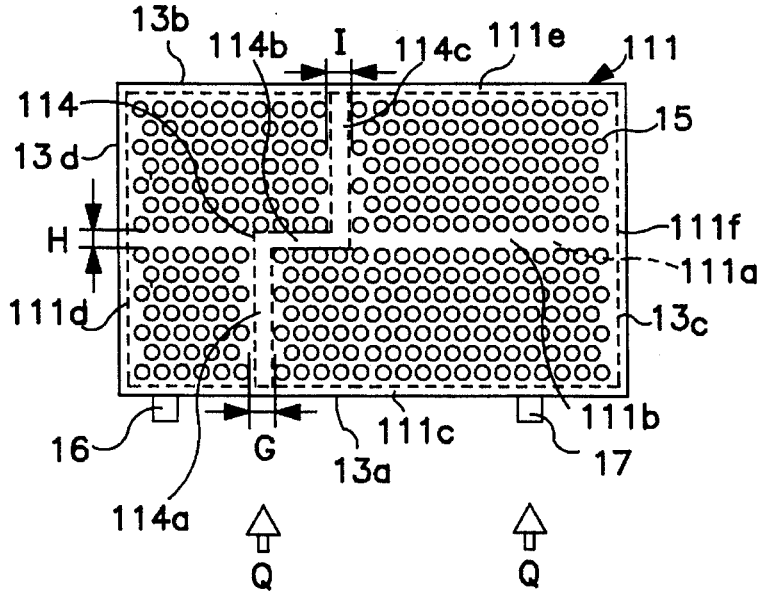
FIG. 10 is a partial, cross-sectional view of the heat exchanger of FIG. 9 taken along line 10—10.

FIGS. 9 and 10 illustrate a fourth embodiment of the present invention. Upper tank 111 is divided into two chambers by an upper partition 114. Partition 114 is preferably substantially perpendicular to first upper plate portion 111*a* and second upper plate portion 111*b*. Further, partition 114 includes first portion 114*a* extending from a first upper side wall 111*c*, second portion 114*b* extending from an end of first portion 114*a* and joining first portion 114*a* with a third portion 113*c*. Third portion 113*c* preferably extends from second portion 114*b* to third upper side wall 111*e*. First portion 114*a* and third portion 113*c* are preferably substantially perpendicular to both first and third upper side wall 111*c* and 111*e*. Second portion 114*b* is preferably substantially parallel to both first and second upper side walls 111*c* and 111*e*.

The configuration of upper partition 114 results in a first pathway G, a second pathway H, and a third pathway I through heat exchanger core 13 when heat transfer tubes 15 are disposed between and connected to first and second tanks 112, 113. Pathways G,H, and I correspond to portions 114*a*, 114*b*, and 114*c*, respectively. Second pathway H is preferably substantially perpendicular to the direction of air flow Q. The result of this configuration is the avoidance of a single pathway extending from first end portion 13*a* of core 13 to second end portion 13*b* of core 13, the entirety of which is in the direction of air flow Q. Thus, no portion of air flow Q can pass through heat exchanger core 13 without striking any of the plurality of heat transfer tubes 15. In these respects, this embodiment is similar to the first embodiment. In this embodiment however, lower tank 112 is not divided into chambers. Instead, lower tank 112 comprises a single chamber. Other features and advantages of this embodiment are similar to those already described above.

This invention has been described in connection with the preferred embodiments. These embodiments, however, are merely exemplary and are not intended to limit the scope of the present invention. It will be obvious to those possessing ordinary skill in the pertinent art that variations of the preferred invention can be easily made within the scope of this invention. For example, a partition in either tank can be made of a variety of shapes and still prevent air from flowing through the core without striking at least one heat transfer tube. Thus, the present invention is not restricted to the described embodiments, but is defined by the claims which follow.

We claim:

1. A heat exchanger through which a heat transfer medium flows, wherein the heat exchanger is exposed to an air flow which flows in a direction, said heat exchanger comprising:

a first tank having an inlet to allow the heat transfer medium to enter the heat exchanger and an outlet to allow the heat transfer medium to exit the heat exchanger;

a first partition disposed in said first tank to divide said first tank into a first number of chambers, wherein said first number of chambers is at least two;

a second tank spaced apart from said first tank a second partition disposed in said second tank to divide said second tank into a second number of chambers, said second number of chambers being one less than said first number of chambers; and a plurality of closely packed heat transfer tubes, each connected at a first end to said first tank and at a second end to said second tank, wherein each of said first and second partitions has at least one portion which is angularly offset from the direction of the air flow, and wherein each said at least one portion of said first and second partitions is perpendicular to the direction of the air flow so that no portion of the airflow can pass through the heat exchanger in a straight line without striking at least one of the plurality of heat transfer tubes and wherein said plurality of closely packed heat transfer tubes is arranged in a plurality of rows, at least one row being adjacent to each of said perpendicular portions of said first and second partitions, and wherein each said perpendicular portion extends past at least two heat transfer tubes of said at least one adjacent row.

2. A heat exchanger through which a heat transfer medium flows, wherein the heat exchanger is exposed to an air flow which flows in a direction, said heat exchanger comprising:

a first tank having an inlet to allow the heat transfer medium to enter the heat exchanger;

a first partition disposed in said first tank to divide said first tank into a first number of chambers, wherein said first number of chambers is at least one;

a second tank spaced apart from said first tank, said second tank having an outlet to allow the heat transfer medium to exit the heat exchanger;

a second partition disposed in said second tank to divide said second tank into a second number of chambers, said second number of chambers being identical to said first number of chambers; and a plurality of closely packed heat transfer tubes, each connected at a first end to said first tank and at a second end to said second tank, wherein each of said first and second partitions has at least one portion which is angularly offset from the direction of the air flow, and wherein each said at least one portion of said first and second partitions is perpendicular to the direction of the air flow so that no portion of the airflow can pass through the heat exchanger in a straight line without striking at least one of the plurality of heat transfer tubes and wherein said plurality of closely packed heat transfer tubes is arranged in a plurality of rows, at least one row being adjacent to each of said perpendicular portions of said first and second partitions, and wherein each said perpendicular portion extends past at least two heat transfer tubes of said at least one adjacent row.

3. A heat exchanger exposed to an air flow which flows in a direction, said heat exchanger comprising:

a first tank;

a second tank spaced apart from said first tank;

a plurality of closely packed heat transfer tubes disposed between said first and second tanks, each of the plurality of heat transfer tubes connected at a first end to said first tank and at a second end to the second tank; and a partition disposed within said first tank to divide said first tank into at least two chambers, wherein said partition has at least one portion which is angularly offset from the direction of the air flow, and wherein said at least one portion is perpendicular to the direction of the air flow so that no portion of the airflow can pass through the heat exchanger in a straight line without striking at least one of the plurality of heat transfer tubes and wherein said plurality of closely packed heat transfer tubes is arranged in a plurality of rows, at least one row being adjacent to said perpendicular portion of said partition, and wherein said perpendicular portion extends past at least two heat transfer tubes of said at least one adjacent row.

* * * * *